United States Patent [19]

Knox, Sr.

[11] 4,422,432

[45] * Dec. 27, 1983

[54] VARIATION OF FUEL VAPORIZER FOR INTERNAL COMBUSTION ENGINE

[76] Inventor: Kenneth L. Knox, Sr., 1796 Hillboro Ave., Reno, Nev. 89512

[ * ] Notice: The portion of the term of this patent subsequent to Mar. 15, 1994, has been disclaimed.

[21] Appl. No.: 199,713

[22] Filed: Oct. 23, 1980

[51] Int. Cl.[3] ..... F02M 29/00

[52] U.S. Cl. ..... 123/592; 481/180 S; 261/79 R

[58] Field of Search ..... 123/590, 592; 48/180 S; 261/79 R

[56] References Cited

U.S. PATENT DOCUMENTS

| | | | |
|---|---|---|---|
| 1,051,369 | 1/1913 | Heath | 123/592 |
| 1,106,452 | 8/1914 | Ittner | 123/592 |
| 2,018,561 | 10/1935 | Lucich | 48/180 S |
| 2,093,918 | 9/1937 | Lord, Jr. | 123/592 |
| 2,119,927 | 6/1938 | Reid | 123/592 |
| 3,955,548 | 5/1976 | Thomas, Jr. | 123/592 |
| 4,011,850 | 3/1977 | Knox, Sr. | 123/592 |

*Primary Examiner*—Charles J. Myhre
*Assistant Examiner*—E. Rollins Cross
*Attorney, Agent, or Firm*—Blair, Brown & Kreten

[57] ABSTRACT

A variation of fuel vaporizer for internal combustion engine is provided that includes an inlet guide vane assembly, and a turbine assembly, the turbine assembly being mounted between the carburetor and intake manifold of the internal combustion engine.

11 Claims, 10 Drawing Figures

VARIATION OF FUEL VAPORIZER FOR INTERNAL COMBUSTION ENGINE

BACKGROUND OF THE INVENTION

The present invention relates to a variation of a fuel vaporizer for internal combustion engines wherein the horsepower of an engine such as a reciprocating or rotary engine will be improved, and wherein miles per gallon will be increased, and also emissions will be minimized.

An inlet guide vane assembly is provided as well as a turbine assembly, so that the fuel air mixture to the engine will be supplied thereto in the most advantageous manner.

The present invention is an improvement over prior fuel vaporizers including prior U.S. Pat. No. 4,011,850 dated Mar. 15, 1977.

SUMMARY OF THE INVENTION

A variation of fuel vaporizer for internal combustion engines is provided that includes a turbine that rotates or whirls at a high rate of speed inside the unit so that initially, droplets of gasoline in the fuel air mixture are physically separated or beat apart, and wherein the impeller unit or turbine assembly renders the resultant mist more readily combustible and wherein expansion takes place in the most proper manner.

A primary object of the present invention is to provide a variation of fuel vaporizer for internal combustion engines that consists of a unit that will improve the horsepower of engines such as reciprocating or rotary engines, and wherein miles per gallon will be increased and also emissions will be minimized.

Still another object of the present invention is to provide a variation of fuel vaporizer for internal combustion engines that includes a turbine assembly that has impeller or turbine shaped blades that whirl or turn at a very high rate inside the unit so that the droplets of gasoline in the fuel air mixture are physically beaten apart, and wherein the turbine or impeller unit assures that the resulting mist will be more readily combustible and wherein the mixture will have the proper amount of expansion.

A further object of the present invention is to provide a variation of a fuel vaporizer for an internal combustion engine that is rugged in structure and simple and inexpensive to manufacture and install, and other objects and advantages will become apparent in the course of the following description.

DESCRIPTION OF THE PREFERRED EMBODIMENT

Figure 1:
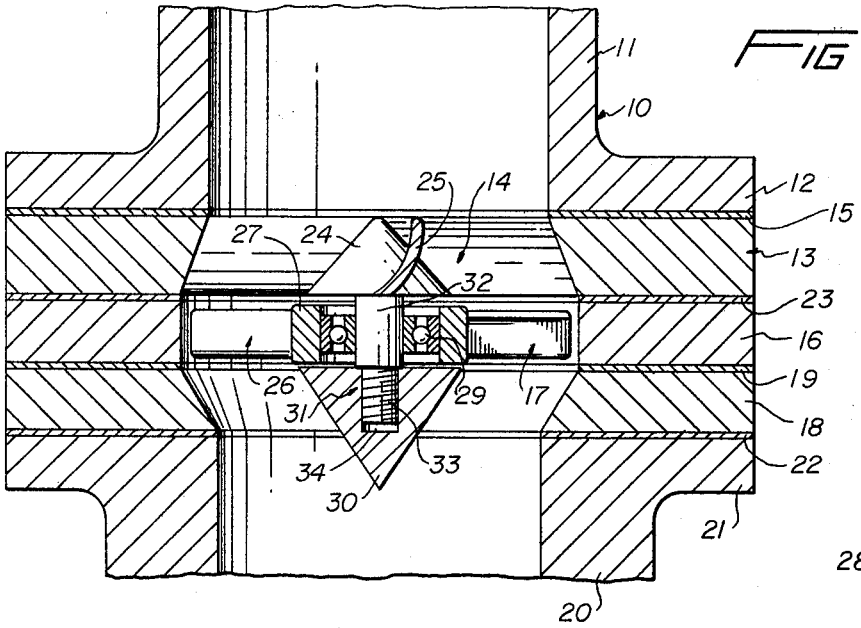
FIG. 1 is a fragmentary sectional view illustrating the variation fuel vaporizer for an internal combustion engine.

Referring in detail to the drawings, and more particularly to FIGS. 1 through 5 of the drawings, the numeral 10 indicates a portion of a carburetor that includes a hollow section 11 as well as a flange portion 12, FIG. 1. An inlet guide vane assembly 14 is provided inside of a member 13, and a gasket 15 is interposed between the members 12 and 13. A turbine spacer 16 has a turbine assembly 17 arranged therein, and a gasket 23 is arranged between the members 13 and 16.

There is further provided a transition member 18, there being a gasket 19 between the members 16 and 18. The numeral 20 indicates a portion of the intake manifold, and the intake manifold 20 may include a flange portion 21, there being a gasket 22 between the portion 21 and member 18 as shown in the drawings.

A cone-shaped member 24 which is stationary, forms part of the inlet guide vane assembly 14, and in the form of the invention shown in FIGS. 1 through 5, there is provided a single inlet guide vane 25.

Figure 2:
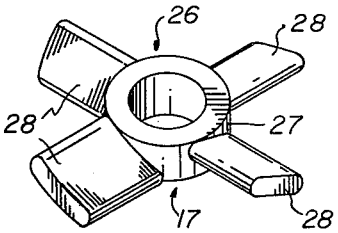
FIG. 2 is a perspective view of the impeller.

As shown in FIG. 2, an impeller or rotating member 26 is provided that includes a hub 27 as well as spaced apart blades 28. A bearing 29 is arranged or mounted within the hub 27.

Figure 4:
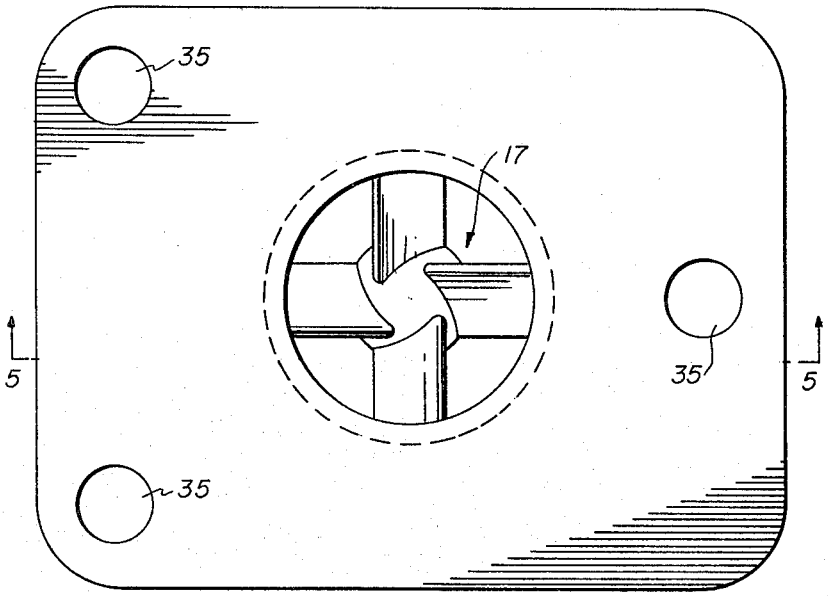
FIG. 4 is a plan view of the present invention.

There is further provided a tail cone 30, and a stud 31 is provided. The stud 31 includes a cylindrical portion 32 as well as a threaded section or portion 33 and threaded section 33 of the stud 31 threadedly engages a threaded socket 34 in the tail cone 30. Openings 35 are provided as shown in FIG. 4.

Figure 6:
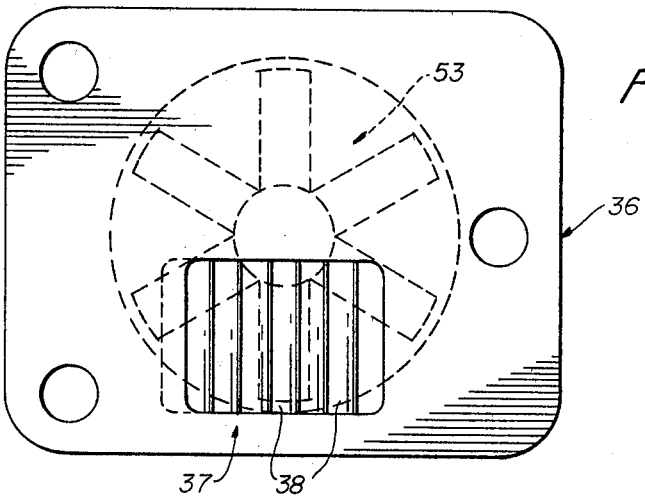
FIG. 6 is a view similar to FIG. 4 but illustrating a modification wherein there is provided an offset intake for the carburetor.

Referring to FIG. 6 of the drawings, there is illustrated a member 36 that shows an offset intake 37 that has a plurality of spaced apart vanes 38, and the device of FIG. 6 illustrates an offset intake being used with the impeller.

Figure 7:
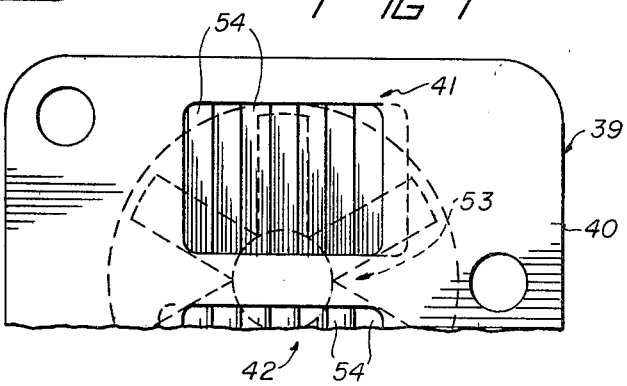
FIG. 7 is a fragmentary elevational view similar to FIG. 6 but illustrating a further modification and showing a plurality of inlets for use with one turbine assembly.

Referring to FIG. 7 of the drawings, there is illustrated a fragmentary plan view of a unit 39 that includes a member 40 that has a pair of carburetor intakes 41 and 42 so that with the arrangement of FIG. 7 it will be seen that a plurality of carburetor intakes can be used with a single turbine.

Figure 10:
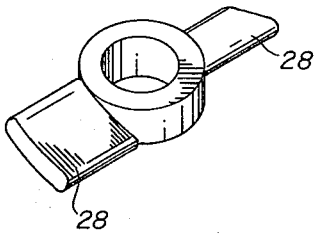
FIG. 10 shows a two bladed version, similar to FIG. 2.
Figure 8:
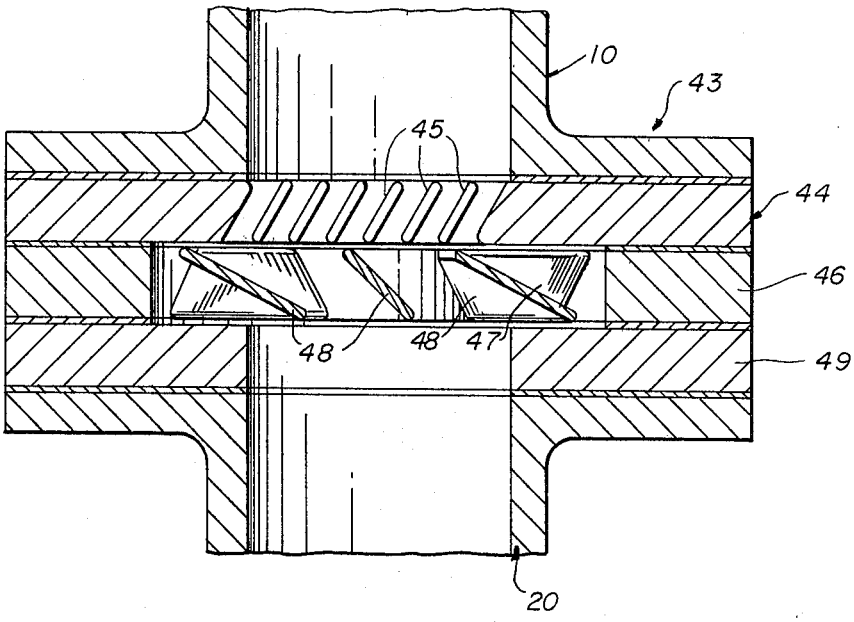
FIG. 8 is a view similar to FIG. 1 but showing a modification wherein there is utilized a plurality of inlet guide vanes.
Figure 9:
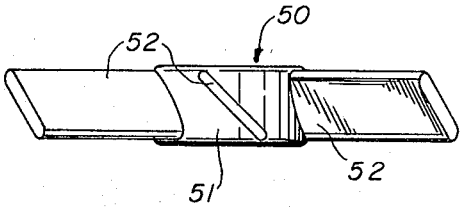
FIG. 9 is a side elevational view of an impeller and showing the blades positioned or arranged at a different angle.

Attention is directed to FIG. 8 of the drawings wherein the numeral 43 indicates a further modified or alternative form of the present invention that is indicated generally by the numeral 43, and in FIG. 8 a member 44 has an inlet guide vane assembly therein that includes a plurality of spaced parallel guide vanes 45. The unit 43 of FIG. 8 further includes a turbine spacer 46 that has an impeller 47 therein, and the impeller 47 is provided with blades 48. A transition member 49 is arranged contiguous to the member 46. Referring to FIG. 9 of the drawings, there is illustrated a modified or alternative impeller or rotating member 50 that includes a hub 51 as well as blades 52. The two bladed version (FIG. 10) has been found to be most effective in increasing the efficiency of the automobile engine.

From the foregoing, it will be seen that there has been provided a variation of fuel vaporizer for internal combustion engines which is an improvement over prior devices including that shown in prior U.S. Pat. No. 4,011,850.

In use, with the parts arranged as shown in the drawings and in particular as shown in FIGS. 1 through 5 of the drawings, the fuel air mixture flows from the carburetor hollow section 11 over the stationary assembly 14, and one or more vanes 25 serves to deflect or guide the fuel air mixture onto the rotary turbine assembly 17 so that the member 17 will rotate at a very high speed in order to assure that the fuel air droplets will be rendered more readily combustible, due to the rotating blades 28. The member 26 includes the hub 27 that rotates on the internal bearing 29. There is further provided the tail cone 30, and this construction serves to assure that the fuel air mixture from the carburetor hollow section 11 to the intake manifold 20 will be properly expanded and acted upon so that the engine will operate at maximum efficiency and with increased horsepower since miles per gallon will be increased. Further, the emissions or pollutants will be substantially eliminated or minimized.

In the arrangement shown in FIG. 6, the unit 36 illustrates intake assembly 37 that is offset from an impeller 53 that forms part of a turbine assembly. In FIG. 7, there is illustrated a plurality of intakes 41 and 42 that are offset from an impeller 53. The intakes 41 and 42 each include a plurality of spaced parallel vanes 54.

In FIG. 8 there is illustrated a unit 43 that comprises an inlet guide vane assembly that has a plurality of spaced parallel vanes 45 for properly deflecting or guiding the fuel air mixture onto the impeller 47 so that this material will impinge against the blades 48 to rotate the impeller or fan or turbine blades 47 whereby the fuel air mixture to the intake manifold 20 will have the proper composition.

Figure 3:
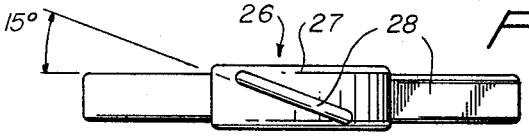
FIG. 3 is an elevational view of the device of FIG. 2.

FIG. 9 illustrates an impeller 50 that includes a central hub 51 that is provided with blades 52 that are arranged at a different angle or different position as for example as compared to the impeller shown in FIG. 3.

It will therefore be seen that there has been provided a variation of fuel vaporizer for internal combustion engines that includes a turbine assembly that threads into the nose cone 24. The turbine includes the bearing 29, and there is further provided the stud 31. Suitable accessories such as shims can be provided where desired or required. The tail cone 30 may have a diameter of 0.812 inches with a length of 0.600 inches, and the tail cone 33 can be made of a suitable material such as aluminum alloy, with the tapped hole 34 for receiving the threaded section 33 of the stud 31. The entire assembly can be fastened with loctite or the like.

Figure 5:
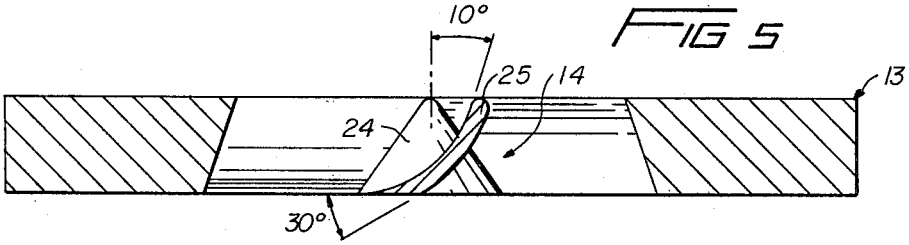
FIG. 5 is a sectional view taken on the line of 5—5 of FIG. 4.

In FIG. 6 the numeral 37 indicates the carburetor inlet, and there is provided the offset arrangement as shown. The hub of the impeller turbine blades or fan is adapted to be bored to fit the bearing such as the bearing 29. As shown in FIG. 3, the blades 28 may be arranged at an angle of approximately 15 degrees with respect to the outer surface of the hub 27. The cone 24 which is the nose cone, may have a diameter of approximately 0.750 inches and the angular arrangement of the vanes 25 may be approximately as illustrated in FIG. 5, that is having a leading edge 15° from a vertical plane and a trailing edge 30° from a horizontal plane.

It is to be understood that the present invention can be used on a dual carburetor and vanes can be slanted in a suitable direction, and the present invention is adapted to cover single, dual, four-barrel carburetors and the like.

In one form of the invention, an eight-fan propeller or vane blade unit can be used or the number of vanes can be varied to a satisfactory number such as 5, and these parts can be arranged to assure maximum performance at high rates of speed.

It is to be understood that the vaporizer of the present invention includes the impeller which is driven at high speed by the flow of air and fuel thereover so that the gasoline or other fuel will be vaporized with the air mixture passing thereover. The inlet guide vane assembly serves to assure that the air fuel mixture will meet the vanes in a most efficient manner to cause the impeller to spin at a very high rate of speed to best vaporize the gasoline passing thereover.

The parts can be made of any suitable material and in different shapes or sizes as desired or required.

The present invention is a unit with air deflectors for controlling the air flow directly into the fan which carries to the mixing chamber and to the intake manifold so that, for example, each cylinder will receive the proper amount of fuel air mixture. Because the vanes turn at a very high RPM, the fuel will be vaporized more efficiently. The present invention is a vaporizing unit that is a fan for vaporization. The greater the speed of rotation of the vanes, the more efficient will be the vaporization of the fuel.

The air deflectors for inlet guide vane assembly and the impeller or fan work in unison to accomplish these desired results, and the blades and vanes are at the proper angle to assure total performance.

The device will improve the horsepower of engines and increase miles per gallon as well as reducing emissions and the like. The blades such as the fan blades 28 turn at high speed inside the unit so that the droplets of gasoline are physically beaten apart, and the impeller unit renders the resultant mist more readily combustible and the expansion that takes place is important. Expansion is important because the lower the pressure of a mist, the more readily it becomes a vapor, and since liquid will not burn, this vaporization is important in an internal combustion engine. As the fuel air mixture passes over the turbine blades of the present invention it goes from a high pressure area into a low pressure area, and at this point if the pressure differential is right, the mixture will flash into a vapor. The lower the temperature of the combustion, the lower the emissions, and with the present invention clean combustion at an efficient air fuel ratio is assured. Clean exhaust is assured, and various types of fuel can be used with the present invention.

The fan pushes air, and the impeller is operated or pushed by air. It is to be understood that the present invention encompasses fans, impellers and the like and for example such members may be of the type that are used for producing artifical currents of air by the motion of a surface and includes any revolving vane or vanes. Such vanes may received the air and the like. Similarly, suitable impellers may be used to provide the driving or propelling force.

Having thus described the preferred embodiment of the invention it should be understood that numerous structural modifications and adaptations may be resorted to without departing from the spirit of the invention.

What is claimed is:

1. In a variation of a fuel vaporizer for internal combustion engines, including a carburetor and an intake manifold, inlet guide vane assembly means carried in a discrete housing member and disposed below said carburetor and above said intake manifold and defined by an opening within said discrete housing member, plural stationary spaced vanes extending across said opening and obliquely angled relative to the direction of flow of fuel and air passing from the carburetor to the intake manifold supported by said housing member, turbine means disposed between said guide vane assembly means and said intake manifold wherein said turbine means includes an impeller embodying a hub, an internal bearing in said hub and a discrete turbine housing surrounding and supporting said impeller oriented in serial registry with said housing member and intake manifold, said inlet guide vane assembly means changes the flow direction of air and fuel before it impinges upon said turbine means to provide better atomization of fuel and a portion where said turbine housing communicates with said stationary vane housing defining a transition pressure area where air/fuel proceeds from a high pressure area to a low pressure area in said turbine housing for improved atomization by flash misting.

2. The structure as defined in claim 1 including a transition member interposed between said turbine housing and the intake manifold oriented in serial registry therebetween.

3. The device of claim 2 wherein plural spaced parallel vanes are disposed in said opening defining said inlet guide vane assembly means.

4. The structure as defined in claim 3 wherein there is provided a plurality of inlet guide vane assemblies with vanes therein, and wherein said assemblies are arranged in spaced apart parallel relation with respect to each other.

5. The device of each claim 4 in which the openings of said plural intakes are offset relative to an axis defined by said hub and stud.

6. The device of claim 2 including gaskets interposed respectively between said carburetor, housing member, turbine housing, transition member and intake manifold for sealing.

7. The device of claim 6 wherein said impeller has blades which are canted at 15 degrees from an horizontal plane.

8. The device of claim 6 wherein said inlet guide vane assembly includes a conical nose cone having a tapered leading edge facing up stream, and a plurality of radially extending stationary vanes having a compound contour for directing the air/fuel to said impeller.

9. The device of claim 8 wherein said stationary vanes having a leading edge canted 10° from a vertical plane and a trailing edge canted at 30° from a horizontal plane.

10. The structure as defined in claim 8 and further including a tail cone operatively connected to a lowermost portion of said impeller and placed in said transition housing, said tail cone having a tapered trailing edge.

11. The structure as defined in claim 10 wherein said inlet guide vane assembly is axially offset from said turbine means, said inlet guide vane assembly having vanes therein.

* * * * *